United States Patent [19]

Harding et al.

[11] 4,365,753

[45] Dec. 28, 1982

[54] BOUNDARY LAYER PREFILMER AIRBLAST NOZZLE

[75] Inventors: Curtis F. Harding, Parma; Harold C. Simmons, Richmond Heights, both of Ohio

[73] Assignee: Parker-Hannifin Corporation, Cleveland, Ohio

[21] Appl. No.: 180,284

[22] Filed: Aug. 22, 1980

[51] Int. Cl.[3] ..... B05B 7/10

[52] U.S. Cl. ..... 239/404; 60/743

[58] Field of Search ..... 293/404, 405, 406, 402, 293/403, 400, 401; 60/735, 740, 743

[56] References Cited

U.S. PATENT DOCUMENTS

| | | | |
|---|---|---|---|
| 3,013,732 | 12/1961 | Webster et al. | 239/404 |
| 3,424,100 | 1/1969 | Schoenecker et al. | 239/405 |
| 3,912,164 | 10/1975 | Lefebure et al. | 239/406 X |

*Primary Examiner*—John J. Love
*Assistant Examiner*—Gene A. Church
*Attorney, Agent, or Firm*—James A. Baker

[57] ABSTRACT

A gas turbine fuel injection nozzle is disclosed in which the secondary fuel is spread into a very thin film entirely within a region of low air momentum. The fuel is therefore not affected by turbulence, and this results in an evenly circumferentially distributed fuel film at the discharge orifice of the nozzle resulting in an even and extremely fine spray of fuel to enhance proper engine performance.

6 Claims, 5 Drawing Figures

BOUNDARY LAYER PREFILMER AIRBLAST NOZZLE

BACKGROUND OF THE INVENTION

As a minimum requirement for satisfactory combustion of fuel in a gas turbine engine, it is essential for the fuel to be atomized into a fine spray of small droplets which are evenly circumferentially distributed at all operating conditions. This necessity has required the development of complex and sophisticated fuel nozzles. During this development, it has become common practice to use a swirl-atomizer in which the fuel is supplied at high pressures to a swirl chamber in which a free vortex is formed. Consequently, the fuel issues from the discharge orifice of the swirl chamber as a thin sheet of conical section which breaks up into a spray of drops by its high velocity interacting with the surrounding air. These nozzles are known typically as pressure atomizers. It has also become common to combine two pressure atomizers, one of low flow capacity known as the "primary" and the other of high flow capacity, known as the "secondary" into a single fuel nozzle. This type of nozzle has conventionally become known as a dual orifice nozzle, as shown in U.S. Pat. No. 3,013,732, the entirety of which is incorporated herein by reference.

To obtain improved fuel atomization over the pressure atomizer, it has become common practice to use high velocity and/or high pressure air as a means of atomizing the fuel. When the air is supplied from a source external to the engine, the nozzle is known as an air-assisted type. When the air is available from inside the engine, it is known as an airblast nozzle.

There are many applications where it is deemed necessary or desirable to combine an air-atomizing nozzle with a pressure atomizing nozzle, such as shown in U.S. Pat. No. 3,912,164, the entirety of which is incorporated herein by reference. In such an arrangement, the pressure atomizer is used for the low fuel flow rate conditions, such as starting the engines, while the air atomizer is used for the higher fuel flow rates. This combination has become conventionally known as a hybrid nozzle.

In some types of airblast nozzles, it may be difficult to obtain optimum spray characteristics due to limitations regarding nozzle shroud and swirl vane geometry. These limitations might arise due to restrictions inside the engine or due to requirements relating to overall geometry. In such a nozzle the fuel, before it has become evenly distributed into a thin sheet, may enter the air stream in a location of high air turbulence (such as in the wake of a swirl vane). This may cause incomplete fuel atomization which will result in less than optimum engine performance.

SUMMARY OF THE INVENTION

The present invention provides a fuel nozzle utilizing the airblast principle for the secondary or high fuel flow requirements, which is specifically designed to alleviate the aforementioned problem of incomplete fuel atomization by avoiding the metering of fuel into local regions of high air turbulence.

More specifically, the present invention provides a nozzle having a pressure atomized "primary" fuel supply and an airblast "secondary" fuel supply. The secondary fuel is spread into a thin cylindrical or conical sheet and is atomized by a high velocity air. The secondary fuel atomization is accomplished by metering the fuel into the high pressure air-stream at such a point where the air is least turbulent (i.e. a region of low and constant air velocity) hence, yielding a finer spray. Other objectives and advantages will become apparent from the description of various embodiments of this invention.

DESCRIPTION OF THE INVENTION

Figure 1:
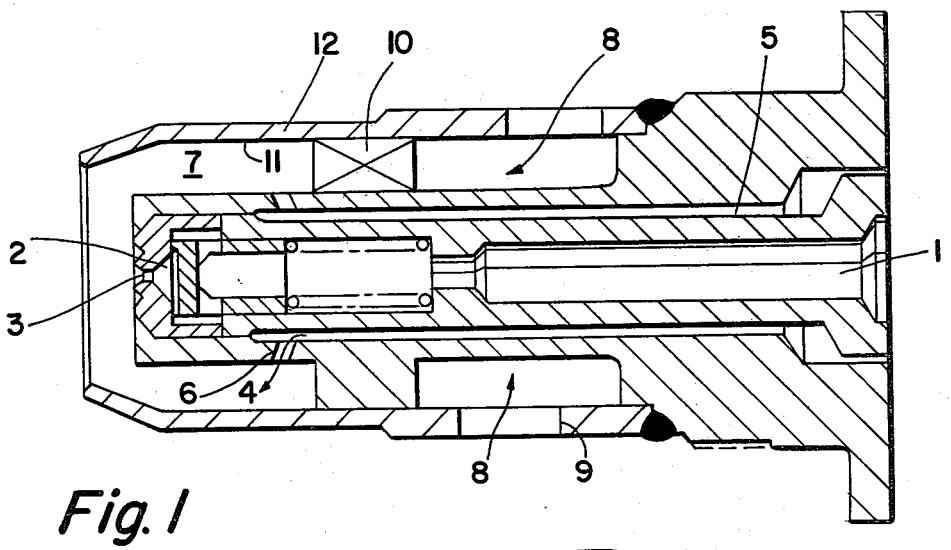
Fig. 1 PRIOR ART
FIG. 1 is a longitudinal cross-sectional view of a nozzle according to the prior art.

The general arrangement of a prior art airblast nozzle is shown in longitudinal cross section in FIG. 1. The primary fuel enters the nozzle through the primary fuel port 1 where it is then directed into the spin chamber 2. The fuel is then pressure atomized via the spin chamber 2 and the discharge orifice 3 wherein a spin is imparted upon it as it is forced through the spin chamber under pressure. The fuel then exits the discharge orifice, at high velocity, in the shape of a spray cone due to the tangential velocity it gained in the spin chamber.

Figure 2:
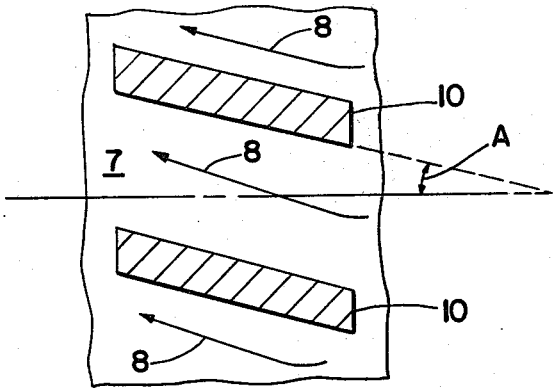
Fig. 2 PRIOR ART
FIG. 2 is a side elevational view of the swirler vane segment of the fuel nozzle shown in FIG. 1, depicting the swirler vane offset and the fuel flow through them.
Figure 3:
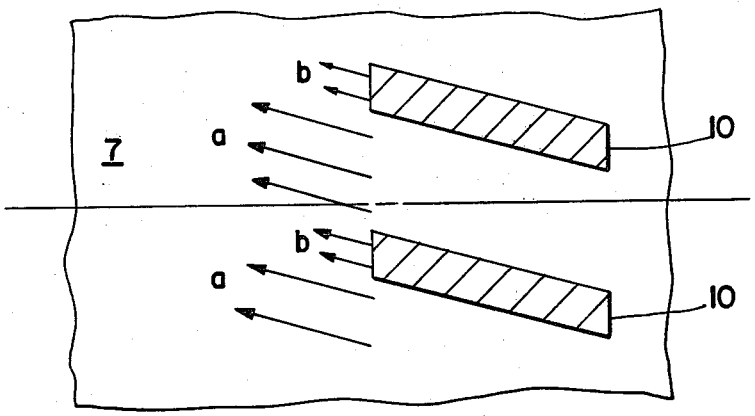
Fig. 3 PRIOR ART
FIG. 3 is a view similar to FIG. 2, but showing regions of relatively high and low air velocity.

The secondary fuel enters the nozzle through the secondary fuel supply annulus 5 and is forced, under pressure, through radial orifices 6 into the air shroud annulus 7. Also entering the air shroud annulus at the same point in time is a stream of high velocity air 8 which enters through several radially located air ports 9. As the air stream 8 enters the nozzle, it is forced under pressure, in an axial direction, through the air shroud annulus 7. Before it exits the air shroud annulus however, it must pass through a set of swirler vanes 10. There are six separate similar vanes 10, and the swirler vanes 10 are spaced circumferentially apart in the air shroud annulus 7 as shown in FIGS. 2 and 3. The swirler vanes 10 act to impart a swirling or spinning motion to the air stream as it passes through them. This is due to the fact that the swirler vanes 10 are not positioned along the length of the air shroud annulus in an axial manner but are set at an angle A to the axis (see FIG. 2).

As then can be seen from FIG. 1, the fuel is injected into the full swirling air stream before the fuel has had a chance to become distributed into a thin sheet on the cylindrical inner peripheral surface 11 of the air shroud 12. The fuel may then become only partially atomized and carried out through the air shroud annulus 7 as part of the air fuel mixture. As the air fuel mixture leaves the air shroud annulus 7, it develops into a spray cone due to the tangential velocity which was imparted onto the air stream by the swirler vanes 10.

This prior art nozzle works very well for many applications, but displays certain drawbacks when used for other applications. Particularly, this nozzle may exhibit incomplete or poor fuel atomization and/or distribution under some conditions which is detrimental to proper engine performance. This poor atomization can be attributed to the fact that the fuel is injected directly into the air stream at a point just behind the swirler vanes. This is a region of changing air velocity which is due to the air wakes which exist directly behind the swirler vanes. The air which passes directly between the vanes will be of a relatively high velocity as indicated by the arrows a, while the air which is directly behind the vanes is of a relatively low velocity as indicated by the arrows b (see FIG. 3). This results in the fuel gathering in heavier concentrations in the regions of low air velocity and in relatively lighter concentrations in the regions of high air velocity. When this occurs, a fuel sheet of varying thickness results which is the cause of uneven fuel atomization since the degree of fuel atomization depends upon the thickness of the fuel sheet. A variation in thickness produces poor fuel atomization while a fuel sheet of consistent thickness produces more even fuel atomization.

Figure 4:
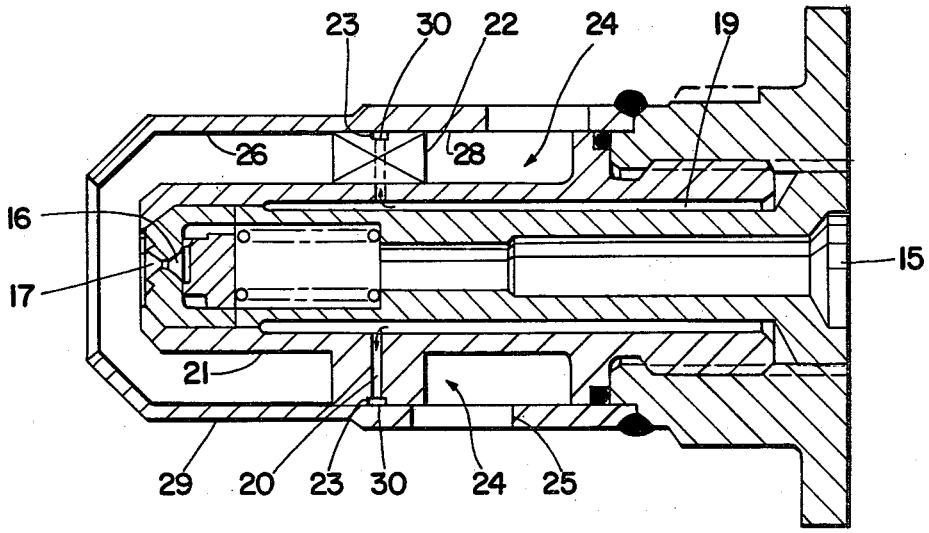
FIG. 4 is a longitudinal cross-sectional view of a nozzle according to the present invention.

The present invention, which overcomes the aforementioned problems, is shown in longitudinal cross section in FIG. 4. As in the prior art nozzle described above, the primary fuel enters the nozzle through the primary fuel port 15 where it is then directed into the spin chamber 16. The fuel is then pressure atomized via the spin chamber 16 and the discharge orifice 17 wherein a spin is imparted upon it as it is forced through the spin chamber under pressure. As in the previous example, the fuel exits the discharge orifice in the shape of a spray cone.

The present invention differs from the prior art in the following respects. The secondary fuel enters the nozzle through the secondary fuel supply annulus 19 and is forced, under pressure, through six radially extending orifices 20 into the air shroud annulus 21. The orifices 20 extend radially through each of the six swirl vanes 22 and convey the fuel from the supply annulus 19 to a circumferentially extending groove 23 in the outer peripheral surface of each swirl vane 22. The grooves 23 each cooperate with the cylindrical inner peripheral surface 28 of the air shroud 29 to form a circumferentially extending passage 30 at the location of each swirl vane 22.

Figure 5:
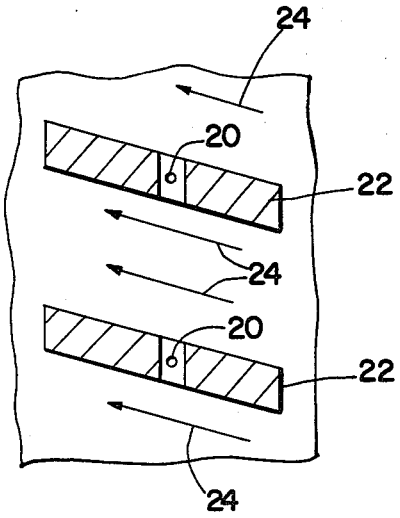
FIG. 5 is a side elevational view of the swirler vane segment of the fuel nozzle shown in FIG. 4, depicting the swirler vane offset and the fuel flow through them.

The lateral cross sectional configuration of the grooves 23 is in a predetermined relation to the lateral cross sectional configuration of the orifices 20. According to this relation, the lateral cross sectional area of each groove 23 (i.e., the area of the groove 23 as viewed in FIg. 4) must be greater than one half the lateral cross sectional area of its corresponding orifice 20 (i.e., the area of the orifice 20 as viewed in FIG. 5). Since one half the flow from each orifice 20 extends in either direction through the passage 23, this relation insures that metering of the fuel flow occurs in the orifices 20, and not in the grooves 23, so that any variation in the area of the passage 30 caused by the dimensional tolerance between the swirl vanes 20 and the inner wall 28 will not affect the flow rate of fuel. In the preferred embodiment, the orifices 20 are each 0.014 inch diameter and the grooves 23 are each 0.018 inch wide and 0.010 deep, so that the lateral cross sectional area of each groove 23 is about 1.3 times that of each orifice 20.

The fuel then flows in a circumferential direction through the passages 30 to the spaces between the swirl vanes 22. The air stream 24 is a stream of high pressure air which enters through several radially located airports 25. As the air stream 24 enters the nozzle it is forced under pressure, in an axial direction, through the air shroud annulus 21. Before it exits the air shroud annulus however, it must pass through the swirler vanes 22 which act to impart a swirling or spinning motion to the air stream.

As can be seen from FIG. 4, the fuel then spreads into a thin even film 26 which adheres closely to the inner surface 28 of the air shroud 29. The ability of the fuel film 26 to adhere to the inner surface 28 of the air shroud 29 is due to the centrifugal force which was imparted to the fluid as it was forced out of the radial orifices 20 and the outer grooves 23. Refering back to the air stream 24, it was stated earlier that in the region behind the swirler vanes 22 the air becomes extremely turbulent due to the differences in velocity of the air stream as it passes through the swirler vanes. However, there exists a region in the air shroud annulus 21 which can be thought of as being a pipe where the air stream velocity is relatively constant. This region is adjacent to the inside wall or surface 29 of the air shroud 27 and is conventionally known as the boundary layer. The principal of the boundary layer effect is a well established physical law, and it need only be said here that when a fluid, such as an air stream, is caused to flow through a pipe, such as an air shroud annulus, the relative velocity of the fluid decreases as it approaches a constraining boundary, such as the inside wall of the air shroud 29. This then means that even though the majority of the air stream within the air shroud 29 is in a turbulent condition, the region of the air stream which is adjacent to the air shroud inner wall 28 is moving at a slower and more constant velocity due to the skin friction between the air stream and the inner wall 28.

The advantages of these two ocurrences can be seen by once again referring to FIG. 4. As stated before, the fuel is injected from the outer grooves 23 into the air shroud annulus 21 and adheres to the inner wall 28 of the air shroud 29 in the form of a thin evenly distributed film or sheet 26. This also happens to be the region known as the boundary layer which, as stated earlier, is where the velocity of the air stream 24 is relatively constant and free from turbulence. It then can easily be seen that this air stream of constant velocity, which exists in the boundary layer greatly enhances the ability of the fuel sheet to form in a very even and uniform manner, much more so than if the fuel were injected directly into the air stream.

It is apparent then that this nozzle, due to the fact that the fuel which is formed or pre-filmed in the boundary layer of the air stream, is much more capable of producing a fuel spray that is fine and evenly distributed than is a nozzle which operates according to prior art. It is also apparent that a gas turbine engine, within which these nozzles are installed, will exhibit better engine performance and will operate more efficiently than if it utilized nozzles of previous designs.

What is claimed is:

1. A fuel nozzle comprising an air shroud having a smooth cylindrical inner peripheral surface, a member within said air shroud and cooperating with said inner peripheral surface to define an air shroud annulus, a fuel source within said member, means for conveying fuel from said fuel source to said inner peripheral surface and for evenly distributing a film of fuel on said inner peripheral surface, said means including a totally enclosed passage extending from said fuel source radially outwardly and terminating at said inner peripheral surface, a swirler vane disposed within said air shroud annulus and arranged at a predetermined angle relative to the longitudinal direction, and said passage includes a passage portion extending radially through said swirler vane and terminating at another passage portion cooperatively defined by said swirler vane and said inner peripheral surface.

2. A fuel nozzle as set forth in claim 1, wherein said other passage portion extends circumferentially from said first mentioned passage portion.

3. A fuel nozzle as set forth in claim 2, wherein said other passage portion extends the entire circumferential width of said swirl vane.

4. A fuel nozzle comprising a generally cylindrical air shroud having a smooth inner peripheral surface, a member within said shroud and cooperating with said inner peripheral surface to define an air shroud annulus, a fuel source within said member, a plurality of spaced apart swirl vanes disposed in said air shroud annulus, and passage means extending through at least one of said swirl vanes for defining the flow path of fuel, said passage means extending from said source of fuel within said member radially outwardly to said inner peripheral surface and terminating at a passage opening cooperatively defined by said swirl vanes and said inner peripheral surface at the boundary layer of the air stream in said air shroud annulus.

5. A fuel nozzle comprising a generally cylindrical air shroud having a smooth inner peripheral surface, a plurality of spaced apart swirl vanes each having an axial length less than the axial length of said air shroud, and passage means in said swirl vanes terminating immediately adjacent said inner peripheral surface at a passage opening cooperatively defined by said swirl vanes and said inner peripheral surface, said passage opening being disposed at a location between adjacent ones of said swirl vanes, whereby fuel is evenly circumferentially distributed on said inner peripheral surface within the boundary layer region of low air velocity in said air shroud.

6. A fuel nozzle comprising a generally cylindrical air shroud having a smooth inner peripheral surface, a plurality of spaced apart swirl vanes each having an axial length less than the axial length of said air shroud, and passage means in said swirl vanes terminating immediately adjacent said inner peripheral surface at a location between adjacent ones of said swirl vanes, said passage means including first and second passage portions, said first passage portion being a hole through at least one of said swirl vanes, said second passage portion being defined by a groove in said one swirl vane and by said inner peripheral surface, and the lateral cross sectional area of said second passage portion being greater than one half the lateral cross sectional area of said first passage portion whereby fuel is evenly circumferentially distributed on said inner peripheral surface within the boundary layer region of low air velocity in said air shroud.

* * * * *